US006928972B2

(12) United States Patent
Biess et al.

(10) Patent No.: US 6,928,972 B2
(45) Date of Patent: Aug. 16, 2005

(54) LOCOMOTIVE AND AUXILIARY POWER UNIT ENGINE CONTROLLER

(75) Inventors: Lawrence J Biess, Jacksonville, FL (US); Christer T Gotmalm, Sault Ste Marie (CA)

(73) Assignee: CSXT Intellectual Properties Corporation, Jacksonville, FL (US)

( * ) Notice: Subject to any disclaimer, the term of this patent is extended or adjusted under 35 U.S.C. 154(b) by 122 days.

(21) Appl. No.: 10/217,632

(22) Filed: Aug. 14, 2002

(65) Prior Publication Data

US 2002/0189564 A1 Dec. 19, 2002

Related U.S. Application Data

(63) Continuation-in-part of application No. 09/773,072, filed on Jan. 31, 2001, now Pat. No. 6,470,844.

(30) Foreign Application Priority Data

Nov. 19, 2001 (CA) ..... 2363582

(51) Int. Cl.[7] ..... F02N 17/02
(52) U.S. Cl. ..... 123/142.5 R
(58) Field of Search ..... 123/142.5 R, 142.5 E, 123/198 D, 196 AB, 179.19, DIG. 8, 198 DC; 290/3, 1 B

(56) References Cited

U.S. PATENT DOCUMENTS

| | | | |
|---|---|---|---|
| 1,974,907 | A | 9/1934 | Worth |
| 1,992,568 | A | 2/1935 | Connor |
| 2,070,615 | A | 2/1937 | Plante |
| 2,155,776 | A | 4/1939 | Starr |
| 2,623,612 | A | 12/1952 | Scheiterein |
| 2,630,106 | A | 3/1953 | Butts |
| 2,664,870 | A | 1/1954 | Wiseman |

(Continued)

FOREIGN PATENT DOCUMENTS

| | | |
|---|---|---|
| GB | 157803 | 6/1921 |
| RU | 93027696 | 6/1993 |
| RU | 2127824 | 3/1999 |
| SU | 1693947 | 10/1996 |

OTHER PUBLICATIONS

Richards, Paul; "Idling: What It Really Costs", Commercial Carrier Journal, Jan. 1995.

Leavitt, Dave, "Emissions: New diesel woes," OEM Off--Highway magazine, Jan. 20000.

Stodolsky, Frank et al. "Lifecycle Analysis for Freight Transport," Total Life Cycle conference and exposition, Dec. 1–3, 1998, SAE International, Warrendale, PA.

Transport Canada, Interim Report: Exposure to Diesel Exhaust Emissions and Noise, Feb. 2, 2000, Ottawa, Canada.

Lorang, Philip A., "Future Nonroad Emission Reduction Credits for Locomotives," *http://www.epa.gov/otag/regs/nonroad/locomotv/locomotv.txt*, viewed Sep. 5, 2000.

EPA Regulatory Announcement, "Final Emission Standards for Locomotives," EPA420–F–97–048, Dec. 1997.

(Continued)

*Primary Examiner*—Henry C. Yuen
*Assistant Examiner*—Hyder Ali
(74) *Attorney, Agent, or Firm*—McGuireWoods LLP

(57) ABSTRACT

Systems and methods for providing auxiliary power to a large diesel engine allow shutdown of the engine in various weather conditions. An auxiliary power unit (APU) comprising a secondary engine coupled to an electrical generator is provided. An automatic control system shuts down the primary engine after a period of idling, and the APU provides electrical power for heating and air conditioning. The APU automatically starts in response to a low coolant temperature, low battery voltage, and low air reservoir pressure. It may also start automatically after extended shutdown to ensure reliability. Automatic primary engine shutdown is defeated if the secondary engine is disabled.

16 Claims, 6 Drawing Sheets

U.S. PATENT DOCUMENTS 2,720,194 A 10/1955 Dilworth
2,794,601 A 6/1957 Steadman et al.
3,134,374 A 5/1964 Stevens
3,236,220 A 2/1966 Holmes
3,304,004 A 2/1967 Hraboweckyj
3,373,728 A 3/1968 Collins
3,400,700 A 9/1968 Lindsey et al.
3,758,031 A 9/1973 Moran
3,795,234 A 5/1974 Stolz
3,844,130 A 10/1974 Wahnish
3,853,270 A 12/1974 Prebil
4,051,825 A 10/1977 Elder
RE29,579 E 3/1978 Simon
4,091,613 A 5/1978 Young
4,192,274 A 3/1980 Damon
4,220,120 A 9/1980 Jackson, deceased et al.
4,245,593 A 1/1981 Stein
4,245,598 A 1/1981 Ruhl
4,249,491 A 2/1981 Stein
4,264,826 A 4/1981 Ullmann
4,305,354 A 12/1981 Majkrzak
4,344,364 A 8/1982 Nickles et al.
4,409,927 A 10/1983 Loesch et al.
4,413,595 A 11/1983 Potts, Jr.
4,424,775 A 1/1984 Mayfield, Jr. et al.
4,425,763 A 1/1984 Porta et al.
4,448,157 A 5/1984 Eckstein et al.
4,452,196 A 6/1984 Indra
4,458,633 A 7/1984 Loesch, deceased et al.
4,494,372 A 1/1985 Cronin
4,503,666 A 3/1985 Christoff
4,524,730 A 6/1985 Doell et al.
4,531,379 A 7/1985 Diefenthaler, Jr.
4,561,057 A 12/1985 Haley, Jr. et al.
4,577,599 A 3/1986 Chmielewski
4,611,466 A 9/1986 Keedy
4,665,319 A 5/1987 Seepe et al.
4,682,649 A 7/1987 Greer
4,711,204 A 12/1987 Rusconi
4,762,170 A 8/1988 Nijjar et al.
4,775,826 A 10/1988 Klema
4,825,633 A 5/1989 Artzt et al.
4,935,689 A 6/1990 Fujikawa et al.
5,064,251 A 11/1991 Romansky
5,065,321 A 11/1991 Bezos et al.
5,072,703 A 12/1991 Sutton
5,113,825 A 5/1992 Takahashi
5,129,605 A 7/1992 Burns et al.
5,219,413 A 6/1993 Lineberger
5,265,567 A 11/1993 Nudds et al.
5,574,469 A 11/1996 Hsu
5,619,956 A 4/1997 Koziara et al.
5,701,062 A 12/1997 Barrett
5,806,011 A 9/1998 Azzaro et al.
5,951,440 A 9/1999 Reichlinger
5,983,156 A 11/1999 Andrews
6,068,447 A 5/2000 Foege
6,112,151 A 8/2000 Kruse
6,148,656 A 11/2000 Breton
6,243,628 B1 6/2001 Bliley et al.
6,257,680 B1 7/2001 Jacob
6,286,479 B1 9/2001 Cryer et al.
6,301,531 B1 10/2001 Pierro et al.
6,363,906 B1 * 4/2002 Thompson et al. ... 123/198 DB
6,470,844 B2 * 10/2002 Biess ..... 123/142.5 R
6,636,798 B2 * 10/2003 Biess et al. ..... 701/112

OTHER PUBLICATIONS

EPA Regulatory Announcement, "Environmental Benefits of Emission Standards for Locomotives", EPA420–F–97–049, Dec. 1997.

EPA Regulatory Announcement, "Federal Preemption of State and Local Control of Locomotives" EPA420–F–97–050, Dec. 1997.

EPA Technical Highlights, "Emission Factors for Locomotives," EPA420–F–97–051. Dec. 1997.

EPA Technical Highlights, "Requirements for Railroads Regarding Locomotive Exhaust Emission Standards," EPA420–F–99–036, Sep. 1999.

EPA Technical Highlights, "Applicability of Locomotive Emission Standards", EPA420–F–990–037, Sep. 1999.

* cited by examiner

LOCOMOTIVE AND AUXILIARY POWER UNIT ENGINE CONTROLLER

This application is a continuation-in-part of U.S. patent application Ser. No. 09/773,072, entitled SYSTEM AND METHOD FOR SUPPLYING AUXILIARY POWER TO A LARGE DIESEL ENGINE, filed Jan. 31, 2001 now U.S. Pat. No. 6,470,884, the contents of which are incorporated herein by reference.

BACKGROUND

1. Field

Embodiments of the present invention relate to large engine systems.

2. Description of Related Art

In diesel fuel powered transportation environments, extremely cold temperatures adversely affect diesel engine operation. Generally, large diesel engines, such as locomotive engines, are not shut down during cold weather conditions due to the difficulty in restarting. Diesel engines do not have the benefit of an electric spark to generate combustion and must rely on heat generated by compressing air to ignite fuel in the engine cylinders.

In low temperature conditions (ambient temperatures below about 40° F.), various factors contribute to the difficulty in starting a diesel engine. First, cold ambient air drawn into the engine must be increased in temperature sufficiently to cause combustion. Second, diesel fuel tends to exhibit poor viscous qualities at low temperatures. Furthermore, engine oil that provides lubrication for an engine is most effective within specific temperature limits, generally corresponding to normal operating temperature of the engine. When cold, the engine lube-oil tends to impede engine starting. Moreover, most engines require a large electrical supply, typically provided by a battery, in order to turn over and start the engine. Batteries are also adversely affected by severe cold weather.

In cold weather, large engines are typically idled overnight to avoid the need to restart in the morning and to provide heat to the crew space. Locomotives that must operate in extremely cold environmental conditions must be run continuously, at high fuel cost, or, when shut down, must be drained of engine coolant and provided with supplemental electrical service and heaters, also at high cost. To avoid engine damage, locomotives typically include a dump valve that activates if the engine coolant comes close to freezing by dumping all of the engine coolant. If a locomotive dumps its main engine coolant, a tank car or tank truck must replenish the coolant prior to restarting of the locomotive, creating delays and increased costs.

In warm weather, locomotive engines typically idle to provide air conditioning and other services, including lighting, air pressure, and power to electrical appliances. If a locomotive is shut down, solid-state static inverters that transform dc power from the locomotive batteries to useful ac power can provide electrical power for air conditioning and other services. Devices such as inverters are parasitic loads that tend to drain the batteries, which may adversely affect engine reliability. Alternatively, wayside electrical power can be supplied, but such power generally does not maintain air conditioning.

Long term idling of large diesel engines results in additional deleterious effects. For example, large diesel engines are susceptible to "wet stacking" due to piston ring leakage caused by idling for long periods of time in cold weather.

Moreover, long term idling is economically inefficient, resulting in primary engine wear, and high fuel and lube-oil consumption, for example.

Several systems have attempted to maintain warmth in a large diesel engine under low temperature ambient conditions. For example, U.S. Pat. No. 4,424,775 discloses an auxiliary engine for maintaining the coolant, lube-oil, and batteries of a primary diesel engine in restarting condition by using the heat of the auxiliary engine exhaust to keep coolant, lube-oil, and batteries sufficiently warm. U.S. Pat. No. 4,762,170 discloses a system for facilitating the restarting of a truck diesel engine in cold weather by maintaining the fuel, coolant, and lube-oil warm through interconnected fluid systems. U.S. Pat. No. 4,711,204 discloses a small diesel engine for providing heat to the coolant of a primary diesel engine in cold weather. The small engine drives a centrifugal pump with restricted flow such that the coolant is heated and then pumped through the primary cooling lines in reverse flow. In such systems, an electrical generator or inverter may be included to maintain a charge for the batteries.

U.S. Pat. No. 5,072,703 discloses an apparatus for restarting a truck diesel engine to maintain a comfortable sleeper compartment temperature. Inputs require that the truck be parked prior to restarting the engine. U.S. Pat. No. 4,577,599 discloses a remote starter for an internal combustion engine that adjusts fuel and air input to the engine based upon engine speed and temperature.

SUMMARY

An object of embodiments of the present invention is to enable a reliable auxiliary power supply system to allow for shutting down a primary diesel engine in all weather conditions.

Another object is to enable a control system that automatically shuts down a primary engine after a certain predetermined period of time, regardless of ambient temperature.

Another object is to enable a control system that automatically starts an auxiliary power supply system having a secondary engine to maintain a primary engine warm in response to a predetermined temperature.

Another object is to enable a control system that maintains fuel, coolant, and lube-oil of a primary engine at a sufficiently warm temperature to facilitate restarting such primary engine in cold weather.

Yet another object is to control starting of a secondary engine based on a variety of conditions. A more specific object is to enable starting of the secondary engine based on an air pressure condition. Another specific object is to enable starting of the secondary engine based on a battery voltage condition. A further specific object is to enable starting of the secondary engine based on inactive time of the secondary engine.

Another object is to isolate a primary engine's batteries when such primary engine is shut down to prevent discharge of the batteries. A more specific object is to provide an electrical generator for charging the primary engine's batteries, as well as for generating standard 240 vac and 120 vac to permit the use of non-vital and hotel loads.

Still another object is to enable a system that disables automatic shutdown features when an auxiliary power supply system is not available to protect the primary engine.

Embodiments of the present invention enable an improved system for providing heating or cooling and electricity to a railroad locomotive in all operating environments, and saves locomotive fuel and lubricating oil. Embodiments herein may further reduce engine emissions by more than 95% and may allow a locomotive operator to obtain EPA (Environmental Protection Agency) credits. An auxiliary power unit comprising a diesel engine coupled to an electrical generator is installed in a locomotive cab. In an embodiment, the engine may be a turbo-charged, four-cylinder diesel engine, such as one manufactured by Kubota, and rated at about 32 brake horsepower, at 1800 RPM. The auxiliary unit engine can draw fuel directly from the main locomotive fuel tank. Equipping the auxiliary unit with a 20-gallon lube-oil sump and recirculating pump to permit extended oil change intervals may reduce maintenance of such auxiliary unit engine. For protection of the auxiliary unit engine, it may also be equipped with over-temperature and low lube-oil pressure shutdowns to prevent engine damage in the event that the engine overheats or runs low on lube-oil.

In an embodiment, the electrical generator may be a 17 kva, 240 vac/60 Hz single-phase generator, mechanically coupled to such engine. A 240 vac/74 vdc battery charger, such as a Lamarche A-40 locomotive battery charger, is provided to maintain the locomotive batteries charged whenever the auxiliary unit is operating.

Embodiments of the present invention allow for automatic shutdown of a primary engine instead of extended idling operation while maintaining a charge on the primary engine's battery. Embodiments of the present invention allow for the operation of cab air conditioning while the primary engine is shut down. Embodiments provide electrical power in standard household voltages for hotel and non-vital loads, allowing for the installation and use of commonly available electrical devices without the need to maintain the primary engine operating. Embodiments provide power to an air compressor without requiring the primary engine to start, and only respond to air pressure signals if a train is attached to the locomotive.

DETAILED DESCRIPTION

Figure 1:
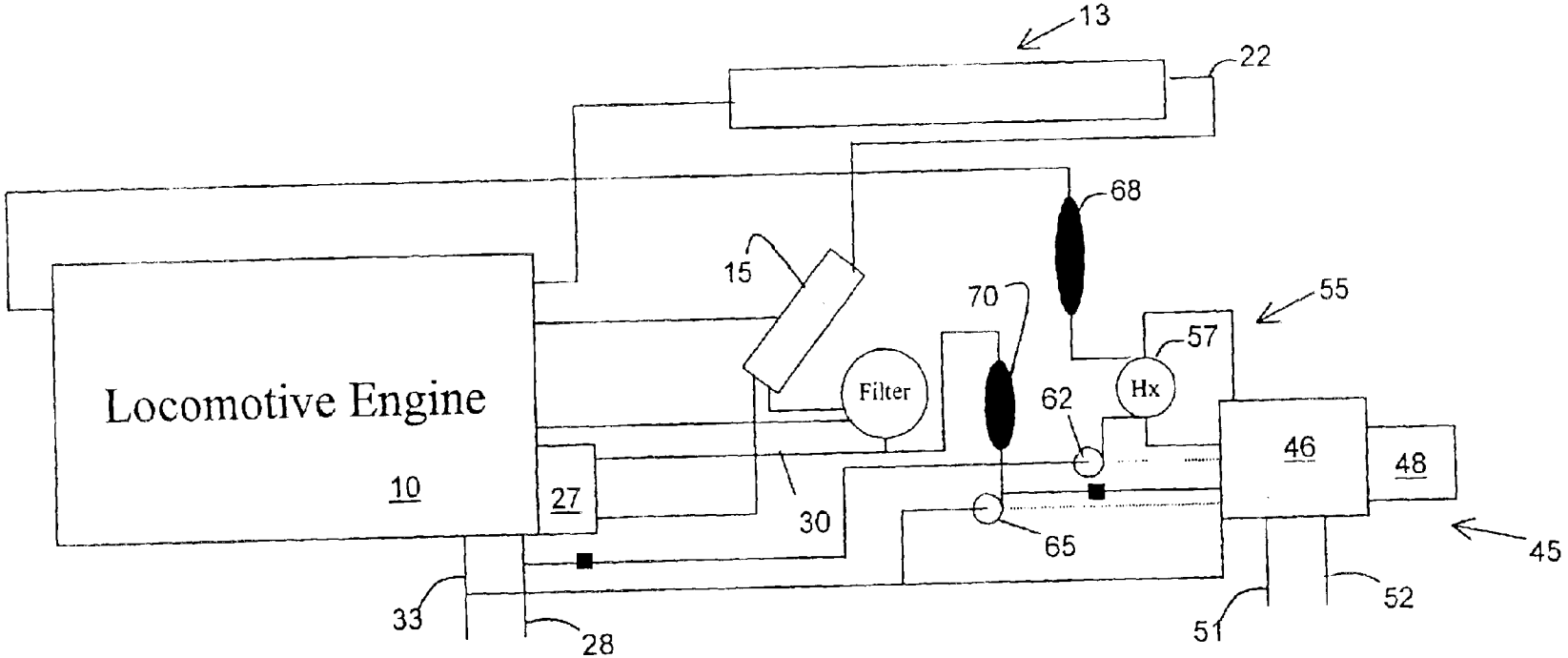
FIG. 1 is a schematic overview of components of an embodiment of the present invention.

Referring now to the drawings, there is presented a system overview of an exemplary embodiment of the present invention. In a specific embodiment, illustrated in FIG. 1, primary locomotive engine 10 includes an integral cooling system having radiator 13 for dissipating heat absorbed from primary locomotive engine 10 and support components such as lube-oil cooler 15. The flow path of coolant forms a closed loop. Such coolant flows through conduits, such as conduit 22, to oil cooler 15 wherein heat is transferred from lubricating oil. Such coolant reenters primary locomotive engine 10 at a suitable location, such as strainer housing 27. Engine coolant drain line 28 may enable removal of coolant during cold weather to prevent freeze damage, if necessary.

Locomotive engine lube-oil provides lubrication for locomotive engine 10 and helps remove heat of combustion. Such lube-oil transfers heat to the locomotive coolant in oil cooler 15 and returns to primary locomotive engine 10 in a closed loop. Filter drain line 30 connects to a suitable location, such as strainer housing 27, and may enable draining of oil from the system during periodic maintenance. During periodic oil changes, lube-oil may be drained from the entire system through a lube-oil drain 33.

In accordance with embodiments of the present invention, there is provided an auxiliary power unit (APU) 45, comprising a secondary engine 46 having an electrical generator 48 mechanically coupled to such secondary engine 46. Secondary engine 46 draws fuel directly from the locomotive engine fuel tank through a common fuel supply for primary locomotive engine 10 at fuel connections 51, 52. Secondary engine 46 includes a separate closed loop coolant system 55 including heat exchanger 57, which is designed to transfer heat generated by operation of secondary engine 46 to a system designed to maintain primary locomotive engine 10 warm.

Two auxiliary loops may be provided to maintain primary locomotive engine 10 warm in cold environmental conditions utilizing two pumps 62, 65. Pump 62 is used for conditioning of coolant. Pump 65 is used for conditioning of lube-oil. The inlet of pump 62 is operatively connected by a conduit to a suitable location in the coolant system of primary locomotive engine 10. The inlet of pump 65 is operatively connected by a conduit to a suitable location in the lube-oil system of primary locomotive engine 10. Coolant heater 68 augments heat exchanger 57 to add heat to primary engine coolant. Oil heater 70 in the lube-oil loop adds heat to locomotive engine lube-oil.

Figure 2:
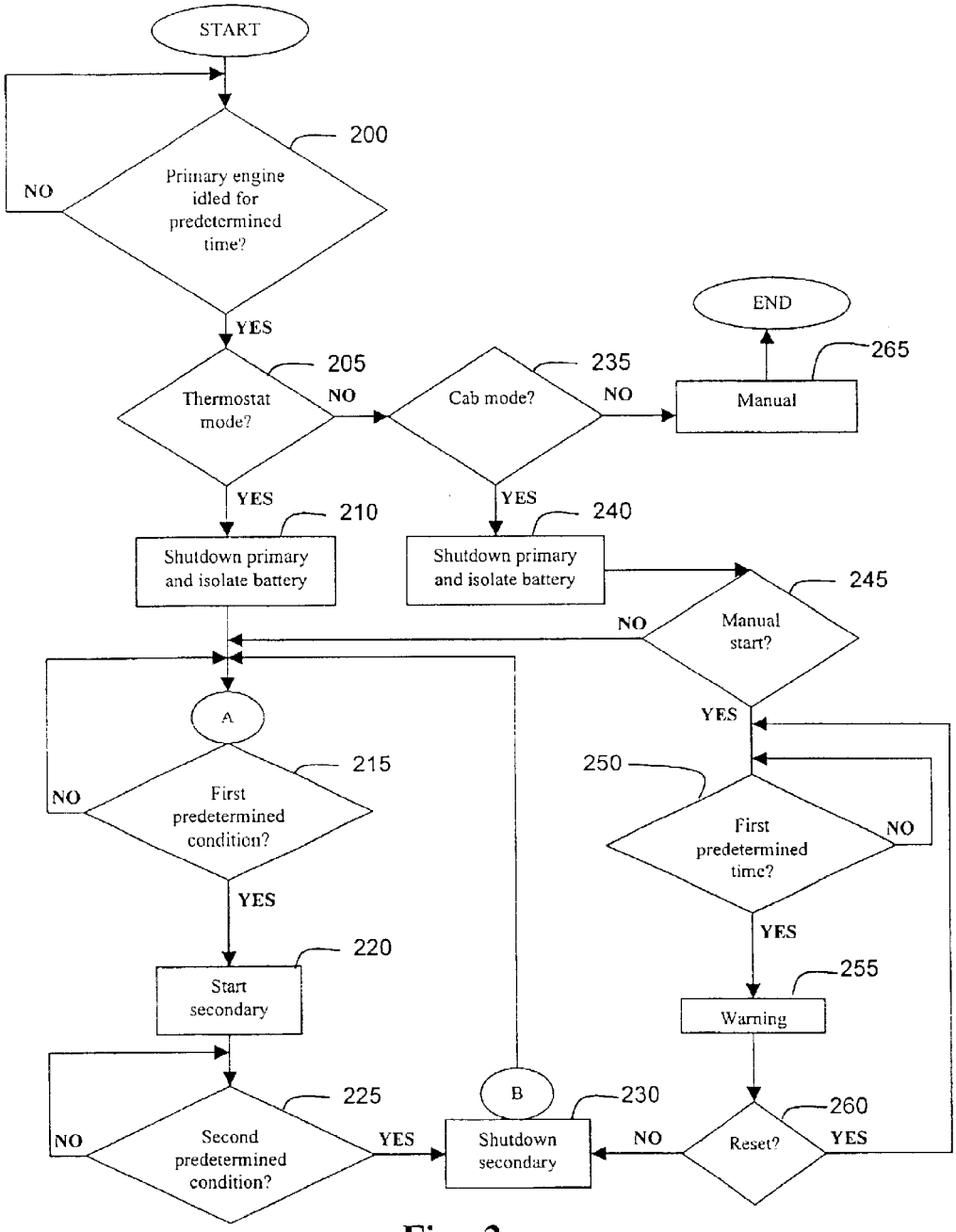
FIG. 2 is a flowchart of a process according to an embodiment of the present invention.

The system of FIG. 1 and other embodiments may be operated in a variety of modes. FIG. 2 is a flowchart of an operational process according to an embodiment of the present invention. In one embodiment, APU 45 can be selected for operation locally at an engine control panel or remotely in the locomotive cab. Control logic may permit operation in any of three exemplary mode—"thermostat," "cab," and "manual"—described below.

During normal operation of primary locomotive engine 10, APU 45 is not in operation. An engine idle timer at task 200 determines if primary engine 10 has been idled for a predetermined period of idle operation, such as 30 minutes. After such period of inactivity, the mode of operation of APU 45 is determined.

If APU 45 is selected to the "thermostat" mode, indicated at task 205, automatic control features shut down primary engine 10 and isolate the primary engine batteries, as indicated at task 210. The "thermostat" mode is an exemplary mode of operation for maintaining primary engine 10 warm during cold weather ambient conditions. In "thermostat" mode, the control system shuts down the primary engine 10 after a predetermined period of idle operation, such as 30 minutes.

In response to a first predetermined condition 215, such as low locomotive coolant temperature, low locomotive lube-oil temperature, or low air pressure, the secondary engine 46 will start 220 in order to warm primary engine systems and/or recharge air reservoir pressure. When a second predetermined condition 225, such as the selected temperature or air pressure, exceeds an established set point, secondary engine 46 automatically shuts down 230. In one embodiment, such condition may be engine coolant temperature as measured by a primary engine block thermostat, or alternate conditions as described below with reference to FIGS. 3, 4, and 5.

If APU 45 is selected to the "cab" mode, indicated at task 235, automatic control features shut down primary engine 10 and isolate the primary engine batteries after a predetermined period of idle operation, as indicated at task 240. The "cab" mode is an exemplary mode of operation for warm weather operation to maximize fuel savings by limiting idling operation of primary engine 10. In "cab" mode, the control system may automatically shut down primary engine 10 after a predetermined period of idle operation, such as 30 minutes. An operator can start APU 45 manually as indicated at task 245. APU 45 may remain responsive to operator command.

In an alternate embodiment, a reset switch can be included in the control logic. Such switch requires that an operator confirm manual operation of APU 45 in "cab" mode. A timer determines the amount of run time of secondary engine 46. After secondary engine 46 has operated for a predetermined time 250, such as two hours, a warning signal 255 is generated. Such warning 255 can be audible, visual, or both, and in some embodiments may send a signal to a remote location. The operator can reset such timer at task 260, in which case the APU 45 may continue to operate. Otherwise, after a predetermined time, such as five minutes after the warning, the secondary engine will shut down at task 230.

In "cab" mode, if an operator does not start secondary engine 46, it may start automatically in response to a first predetermined condition, such as low coolant temperature, low lube-oil temperature, or low air pressure, and shut down when the selected condition exceeds an established set point as described for "thermostat" control above. In a further alternate embodiment, an override may be provided to permit extended idling operations at the discretion of the operator.

The "manual" mode, indicated at task 265, allows APU 45 to be started by manually priming secondary engine 46. This provision may allow for operation of APU 45 in the event that automatic start up features malfunction, or to prime secondary engine 46 in the event that it runs out of fuel.

In the described modes of operation, APU 45 may charge the primary engine batteries and provide power to thermostatically controlled cab heaters and 120 vac lighting and receptacles. In operation, when primary engine 10 is shut down automatically, an analog or solid state device (such as a relay or transistor) may automatically isolate the primary batteries from 74 vdc loads to prevent discharge of the locomotive batteries after a period of time following a main engine shutdown and during the shutdown period.

In another embodiment, startup of APU 45 can be conditioned on a variety of parameters to protect the locomotive engine and minimize emissions. For example, if a stationary locomotive is alone or isolated, it may not be necessary to maintain air pressure for the train brakes. However, if such locomotive has a train behind it, then it may be important to maintain sufficient pressure in the brake pipe.

Figure 3:
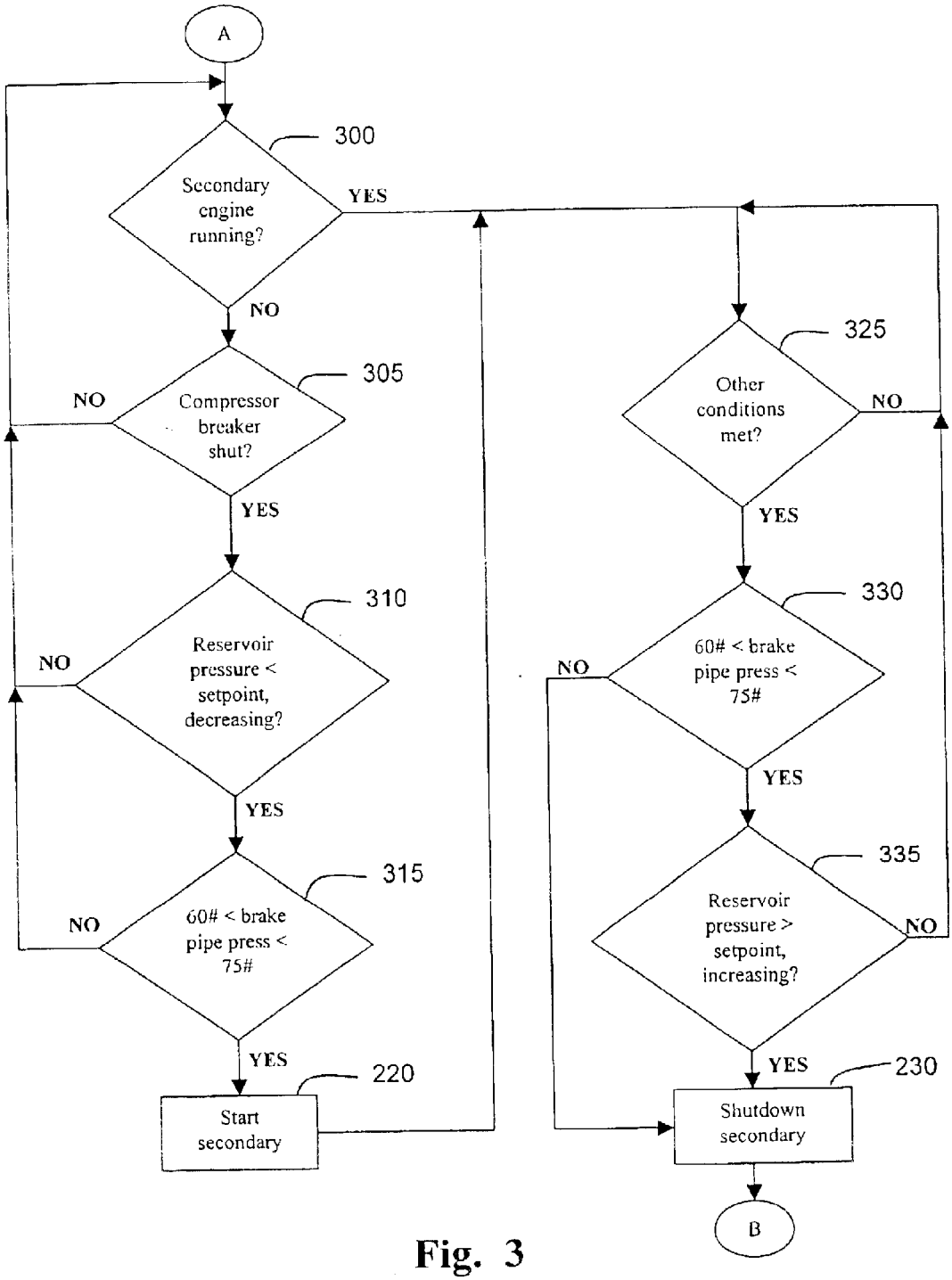
FIG. 3 is a partial flowchart of a process according to an embodiment of the present invention relating to air control operation.

FIG. 3 is a partial flowchart of a process according to an embodiment of the present invention. In the embodiment of FIG. 3, APU 45 is started by air pressure. Entry point A and exit point B correspond to like notations in FIG. 2 concerning first and second predetermined conditions.

If secondary engine 46 is not running at task 300, then the control logic checks to see if the air compressor breaker is shut. This task may be omitted if the secondary engine 46 mechanically drives the air compressor. If the breaker is shut, then the reservoir air pressure is checked to determine if such pressure is below a predetermined setpoint and is decreasing 310. The pressure in the train brake pipe is checked to determine if pressure is between approximately 60 psi and approximately 75 psi at task 315. Train brake pipe pressure may only be within this band if a train is attached to the locomotive. If all the conditions are met, APU 45 is started at task 220. The control logic will only start the APU 45 due to air pressure in order to charge the air reservoir if a train is attached to the locomotive.

Once APU 45 is operating, it may stay running to warm the coolant and lube-oil or charge the primary batteries. If any of the temperature or voltage conditions are not met at task 325, the APU continues to operate. If other conditions are met, then the control logic checks to determine if a train is attached at task 330. If not, the APU is shut down 230. Otherwise, a check is made to determine if the air reservoir pressure has risen above a predetermined setpoint 335. When air pressure is restored, APU 45 can be shut down 230.

Figure 4:
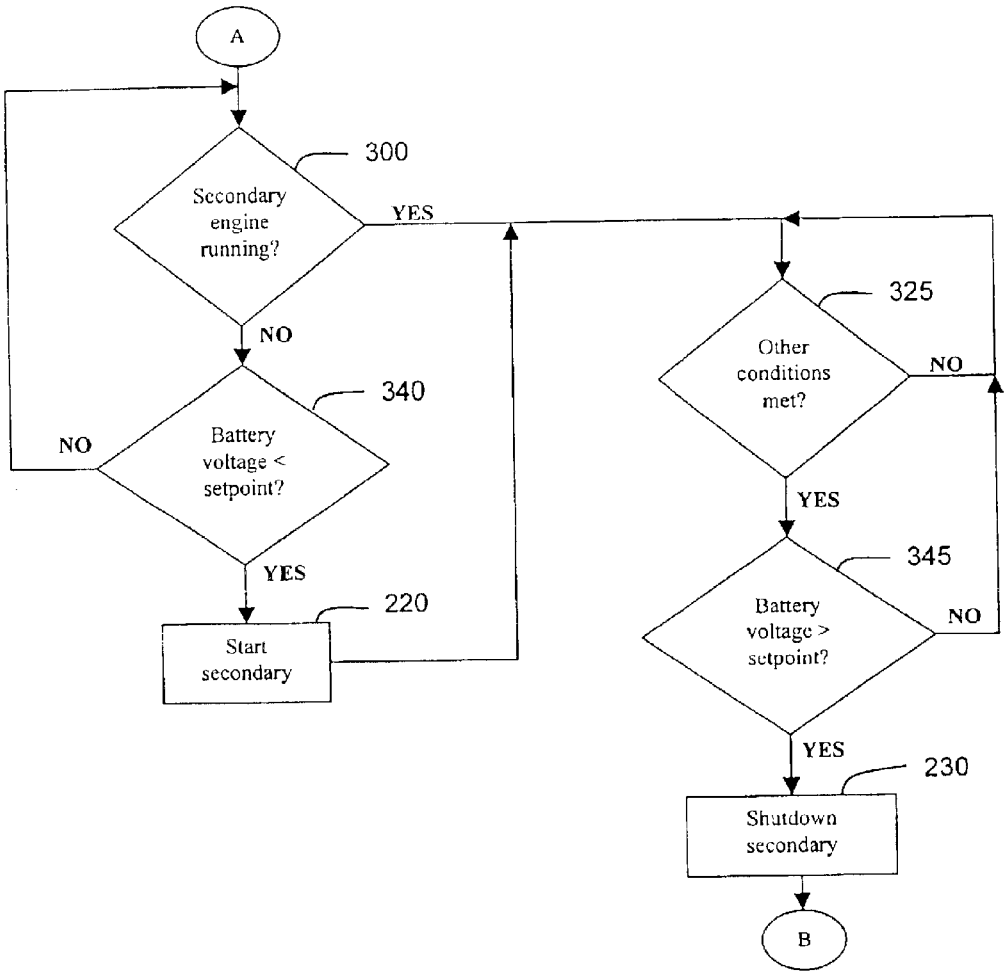
FIG. 4 is a partial flowchart of a process according to an embodiment of the present invention relating to battery voltage control operation.

Primary engine 10 cannot be started if the primary batteries have insufficient voltage. FIG. 4 is a partial flowchart of a process according to an embodiment of the present invention. In the embodiment of FIG. 4, APU 45 is started by low voltage on the primary batteries. Entry point A and exit point B correspond to like notations in FIG. 2 concerning first and second predetermined conditions.

If secondary engine 46 is not running at task 300, then the control logic checks to determine if the voltage on the primary batteries is below a predetermined level at task 340. If so, the secondary engine 46 is started at task 220.

Once APU 45 is operating, it may stay running to warm the coolant and lube-oil or recharge the air reservoir. If any of the temperature and pressure conditions are not met at task 325, the APU continues to operate. If other conditions are met, then the control logic checks to determine if the primary batteries are recharged 345. When battery voltage is restored, APU 45 can be shut down 230.

To keep the primary engine 10 safe and ensure that APU 45 will start when required for cold weather protection or to maintain brake pipe air pressure, secondary engine 46 may be periodically operated for brief periods to detect any potential difficulties.

Figure 5:
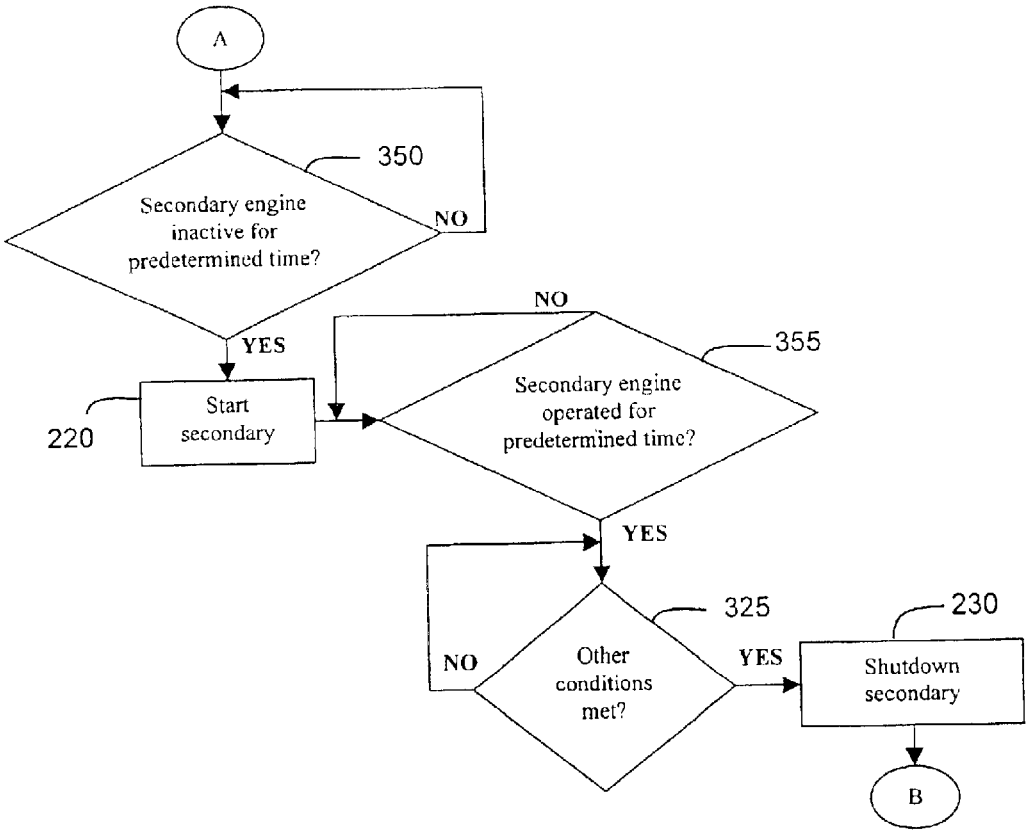
FIG. 5 is a partial flowchart of a process according to an embodiment of the present invention relating to inactive time control operation.

FIG. 5 is a partial flowchart of a process according to an embodiment of the present invention. In the embodiment of FIG. 5, inactive time control operation of the system is implemented. Entry point A and exit point B correspond to like notations in FIG. 2 concerning first and second predetermined conditions.

If secondary engine 46 has been inactive for a predetermined period of time, such as 48 hours or 72 hours, as indicated at task 350, then APU 45 can be automatically started based on time 220. In such a case, secondary engine 46 may be operated for a predetermined period of time, such as 30 minutes to an hour (task 355), to allow temperatures in secondary engine 46 to stabilize and enable sufficient time for an operator or automated verification mechanism, such as a processor, to verify correct running of the system.

Once APU 45 has been operating for a predetermined period of time, it may stay running to warm the coolant and lube-oil, recharge the air reservoir, and/or charge the primary batteries. If any of the conditions are not met at task 325, the APU continues to operate. If other conditions are met, secondary engine 46 is shut down 230.

In an alternate embodiment, external audible and visual alarms can sound and light if APU 45 fails to start during any automatically initiated attempt to start. These alarms may be battery operated so they are not reliant on the secondary engine running. In an exemplary implementation, such alarms may include a wireless communication system to connect to a remote operator center.

Figure 6:
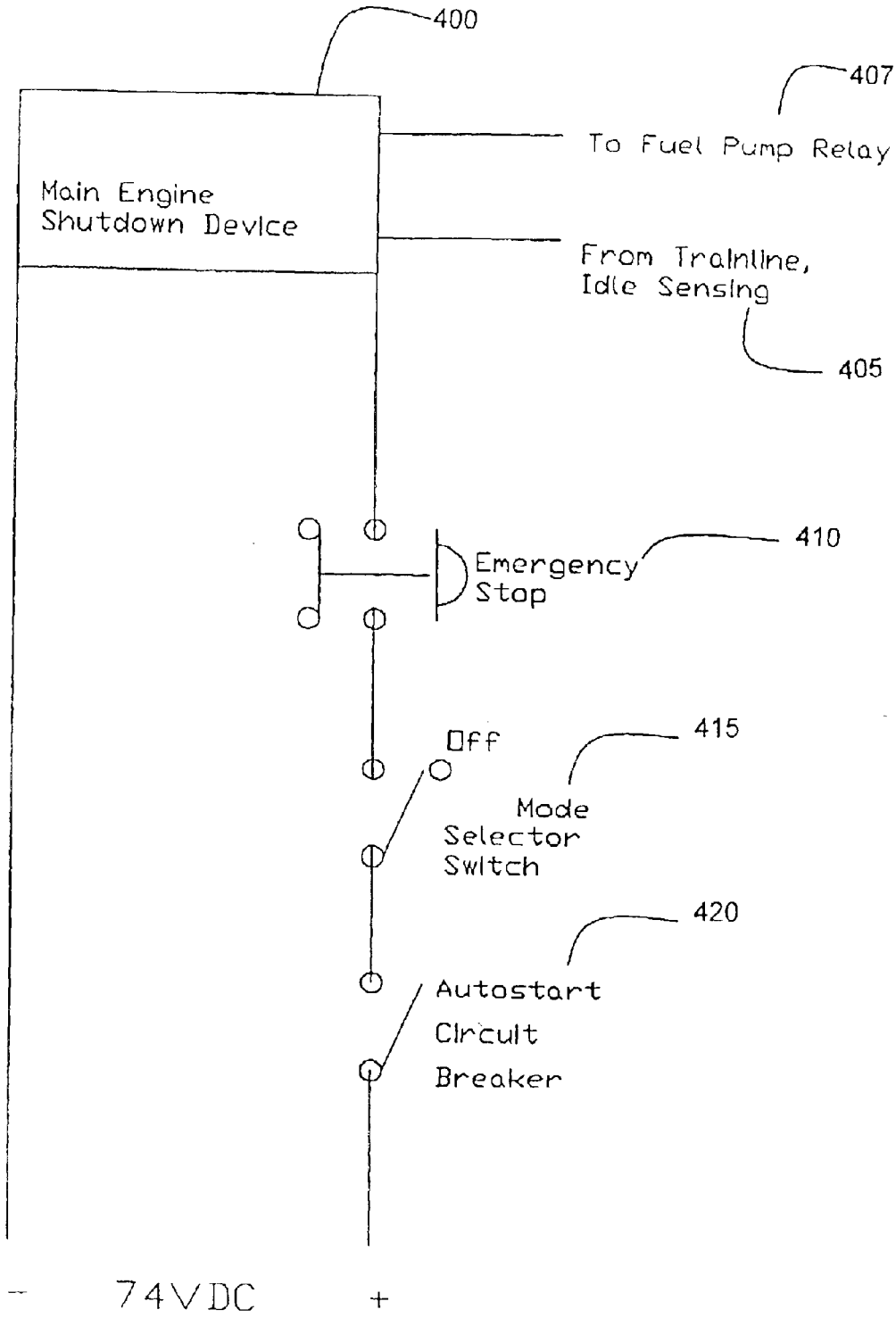
FIG. 6 is a functional schematic diagram of inputs to defeat the primary engine idle time features of a system according to an embodiment of the present invention.

If APU 45 is not available to protect primary engine 10, then it may not be safe to automatically shut down primary engine 10. FIG. 6 is a functional schematic diagram of inputs to defeat the primary engine idle time features of a system according to an embodiment of the present invention.

Main engine shutdown device 400 normally receives power from 74 vdc primary batteries. Sensor input to the shutdown device 400 comprises an idle sensor 405, and output of the shutdown device 400 goes to fuel pump relay 407, to stop fuel to the primary engine 10. Idle shutdown is defeated when the APU emergency stop switch 410 is activated, if the APU mode selector switch 415 is selected to "OFF," or if power is removed from the APU automatic start at its circuit breaker 420. By integrating such exemplary inputs, the primary engine may be protected from automatic shutdown if the APU is not available.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein. Therefore, for purposes of determining the scope of patent protection, reference shall be made to the appended claims in combination with the above detailed description.

What is claimed is:

1. An auxiliary power system for operation in cooperation with a primary engine, comprising:

(A) a secondary engine, and (B) control means having a timer, wherein:

(i) the control means that automatically shuts down the primary engine in response to expiration of a predetermined time period of idling of the primary engine;

(ii) the control means sheds loads from the primary engine upon shutdown; and (iii) the control means enables automatic startup of the secondary engine.

2. The auxiliary power system of claim 1, wherein:

the primary engine includes a coolant system; and the control means automatically starts the secondary engine, at least in part, in response to a predetermined temperature of the primary engine coolant system.

3. The auxiliary power system of claim 1, wherein:

the primary engine includes a lube-oil system; and the control means automatically starts the secondary engine, at least in part, in response to a predetermined temperature of the primary engine lube-oil system.

4. The auxiliary power system of claim 1, wherein:

the primary engine includes an air system; and the control means automatically starts the secondary engine, at least in part, in response to a predetermined pressure of the primary engine air system.

5. The auxiliary power system of claim 1, wherein:

the primary engine includes a battery; and the control means automatically starts the secondary engine, at least in part, in response to a predetermined voltage of the primary engine battery.

6. The auxiliary power system of claim 1, wherein:

the control means includes a second timer; and the control means automatically starts the secondary engine, at least in part, in response to a predetermined period of inactivity of the secondary engine.

7. The auxiliary power system of claim 1, further comprising an electrical power producing means driven by the secondary engine.

8. The auxiliary power system of claim 7, further comprising battery charging means.

9. The auxiliary power system of claim 8, wherein:

the control means (i) isolates the battery of the primary engine from dc loads upon automatic shutdown of the primary engine, and (ii) continuously charges the battery during operation of the secondary engine.

10. The auxiliary power system of claim 2, further including:

coolant temperature sensing means, and wherein the control means maintains primary engine coolant temperature within a predetermined temperature range.

11. The auxiliary power system of claim 3, further including:

primary lube-oil temperature sensing means, and wherein:

the control means maintains primary engine lube-oil temperature within a predetermined temperature range.

12. The auxiliary power system of claim 1, further comprising:

fuel heating means.

13. The auxiliary power system of claim 12, further including:

fuel temperature sensing means, and wherein:

the control means maintains fuel temperature within a predetermined temperature range.

14. A method of supplying auxiliary power to a primary engine, comprising:

(A) providing a secondary engine coupled to an electrical generator;

(B) monitoring an operating condition of the primary engine;

(C) automatically shutting down the primary engine in response to expiration of a predetermined period of idling time of the primary engine;

(D) shedding the loads from the primary engine upon shutdown; and (E) automatically starting the secondary engine, at least in part, in response to a predetermined condition of the primary engine.

15. The method of claim 14, wherein the predetermined condition of the primary engine is selected from the group consisting of:

(i) non-operation of the primary engine combined with a predetermined temperature of the primary engine coolant or lube-oil;

(ii) non-operation of the primary engine combined with a predetermined air pressure; and (iii) non-operation of the primary engine combined with a predetermined battery voltage.

16. The method of claim 14, further comprising:

(E) starting the secondary engine following inactivity of the secondary engine for a predetermined period of time.

* * * * *